US007415969B2

(12) United States Patent
Sun et al.

(10) Patent No.: US 7,415,969 B2
(45) Date of Patent: Aug. 26, 2008

(54) FUEL INJECTOR HAVING RECESSED CHECK TOP

(75) Inventors: Jinhui Sun, Bloomington, IL (US); Dennis H. Gibson, Chilicothe, IL (US); Haijun Kang, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 89 days.

(21) Appl. No.: 11/363,259

(22) Filed: Feb. 28, 2006

(65) Prior Publication Data

US 2007/0199544 A1 Aug. 30, 2007

(51) Int. Cl.
*F02M 59/46* (2006.01)
*F02M 41/16* (2006.01)

(52) U.S. Cl. ..... 123/467; 239/96

(58) Field of Classification Search ..... 123/467, 123/446, 447; 239/88–96
See application file for complete search history.

(56) References Cited

U.S. PATENT DOCUMENTS 3,669,360 A * 6/1972 Knight ..... 239/533.5
4,006,859 A * 2/1977 Thoma ..... 239/89
4,168,804 A * 9/1979 Hofmann ..... 239/533.11
4,213,434 A * 7/1980 Vogtmann et al. ..... 123/462
4,269,360 A * 5/1981 Kopse ..... 239/533.8
4,552,310 A * 11/1985 Gaskell ..... 239/533.5
4,798,186 A * 1/1989 Ganser ..... 123/467
4,840,310 A * 6/1989 Haider ..... 239/533.4
4,962,890 A * 10/1990 Shindo et al. ..... 239/533.4
5,029,568 A * 7/1991 Perr ..... 123/447
5,127,583 A * 7/1992 Taue ..... 239/96
5,167,370 A * 12/1992 Henkel ..... 239/533.8
5,407,131 A 4/1995 Maley et al.
5,412,706 A * 5/1995 Deibel ..... 378/162
5,487,508 A * 1/1996 Zuo ..... 239/533.5
5,647,536 A * 7/1997 Yen et al. ..... 239/90
5,685,490 A * 11/1997 Ausman et al. ..... 239/533.9

(Continued)

FOREIGN PATENT DOCUMENTS

WO WO 03/067070 8/2003

(Continued)

OTHER PUBLICATIONS

International Search Report from the European Patent Office.

*Primary Examiner*—Thomas N Moulis
(74) *Attorney, Agent, or Firm*—Finnegan, Henderson, Farabow, Garrett & Dunner

(57) ABSTRACT

A fuel injector for a machine is disclosed. The fuel injector has a nozzle member with a first end and a second end. The first end of the fuel injector has at least one orifice. The fuel injector also has a control chamber located at the second end of the nozzle member with an end wall portion approximately orthogonal to an axial direction of the nozzle member. The fuel injector further has a port disposed in the end wall portion of the control chamber and at least one passageway in fluid communication with the control chamber via the port. The fuel injector additionally has a needle valve element with a tip end and a base end. The tip end is configured to selectively block fuel flow through the at least one orifice. The base end has a recess configured to cap off the port.

25 Claims, 4 Drawing Sheets

U.S. PATENT DOCUMENTS

| | | | | |
|---|---|---|---|---|
| 5,832,954 | A | 11/1998 | Shafer | |
| 5,860,597 | A * | 1/1999 | Tarr | 239/124 |
| 6,145,492 | A * | 11/2000 | Lixl | 123/467 |
| 6,354,271 | B1 | 3/2002 | Satapathy | |
| 6,412,473 | B1 | 7/2002 | Nan et al. | |
| 6,422,208 | B1 * | 7/2002 | Ertem et al. | 123/467 |
| 6,450,778 | B1 * | 9/2002 | Spoolstra et al. | 417/307 |
| 6,647,966 | B2 * | 11/2003 | Tian et al. | 123/467 |
| 6,663,014 | B1 | 12/2003 | Depayva et al. | |
| 2004/0144366 | A1 | 7/2004 | Grabandt | |
| 2004/0169092 | A1 | 9/2004 | Boehland | |
| 2005/0028788 | A1 | 2/2005 | Shafter et al. | |

FOREIGN PATENT DOCUMENTS

| | | |
|---|---|---|
| WO | WO 03/078828 | 9/2003 |

* cited by examiner

FUEL INJECTOR HAVING RECESSED CHECK TOP

TECHNICAL FIELD

The present disclosure is directed to a fuel injector and, more particularly, to a fuel injector having a recessed check top.

BACKGROUND

Common rail fuel systems typically employ multiple closed-nozzle fuel injectors to inject high pressure fuel into combustion chambers of an engine. Each of these fuel injectors may include a nozzle assembly having a cylindrical bore with a nozzle supply passageway and a nozzle outlet. A needle check valve may be reciprocatingly disposed within the cylindrical bore and biased toward a closed position where the nozzle outlet is blocked. To inject fuel, the needle check valve may be selectively moved to open the nozzle outlet, thereby allowing high pressure fuel to spray from the nozzle supply passageway into the associated combustion chamber.

One way to move the needle check valve between the open and closed positions includes draining and filling a control chamber associated with a base of the needle check valve. In particular, the control chamber may be filled with pressurized fluid to retain the needle check valve in a closed position and selectively drained of the pressurized fluid to bias the needle check valve toward the open position. When in the open position, the flow of pressurized fuel to the control chamber may be restricted by the base of the needle check valve, thereby minimizing losses associated with pressurized fuel draining to a low pressure reservoir.

One problem associated with this fuel injector arrangement involves efficiency. In particular, although the flow of pressurized fuel to the control chamber may be restricted to minimize losses, some fuel may still be allowed to drain to the low pressure reservoir because the base of the needle check valve does not completely block the flow of pressurized fuel into the control chamber. A method implemented by engine manufacturers to reduce this loss of pressurized fuel and improve efficiency of the affected engine includes changing the shape of the needle check valve base to provide better sealing of the control chamber. One example of changing the needle check valve base is described in U.S. Pat. No. 5,487,508 (the '508 patent) issued to Zuo on Jan. 30, 1996. The '508 patent describes a fuel injector nozzle and tip assembly comprising a check housing defining a cavity with a spray orifice at one end and a control port at the other end. A needle check valve is disposed in the cavity and has a tip at one end for blocking the orifice, and a control port check at the other end for blocking the control port. The control port check is conical in shape for seating against a complementarily shaped seat of the control port.

Although the fuel injector nozzle of the '508 patent may reduce the loss of pressurized fuel and improve efficiency of an associated engine by changing the geometry of the control port check, it may be problematic and expensive. For example, because the seating surfaces of the control port check and control port are conical and designed to engage each other, even slight misalignment between the two surfaces could result in leakage of the pressurized fuel. In addition, the two conical seating surfaces may be difficult and expensive to fabricate.

The fuel injector of the present disclosure solves one or more of the problems set forth above.

SUMMARY OF THE INVENTION

One aspect of the present disclosure is directed to a fuel injector. The fuel injector includes a nozzle member with a first end and a second end. The first end of the fuel injector has at least one orifice. The fuel injector also includes a control chamber located at the second end of the nozzle member with an end wall portion approximately orthogonal to an axial direction of the nozzle member. The fuel injector further includes a port disposed in the end wall portion of the control chamber and at least one passageway in fluid communication with the control chamber via the port. The fuel injector additionally includes a needle valve element with a tip end and a base end. The tip end is configured to selectively block fuel flow through the at least one orifice. The base end has a recess configured to cap off the port.

Another aspect of the present disclosure is directed to a method of injecting fuel into a combustion chamber of an engine. The method includes fluidly communicating through a port with a control chamber associated with a nozzle member. The method also includes selectively moving a needle valve element to block the fluid communication through the port, and retaining fuel within the needle valve element when the fluid communication through the port is blocked.

DETAILED DESCRIPTION

Figure 1:
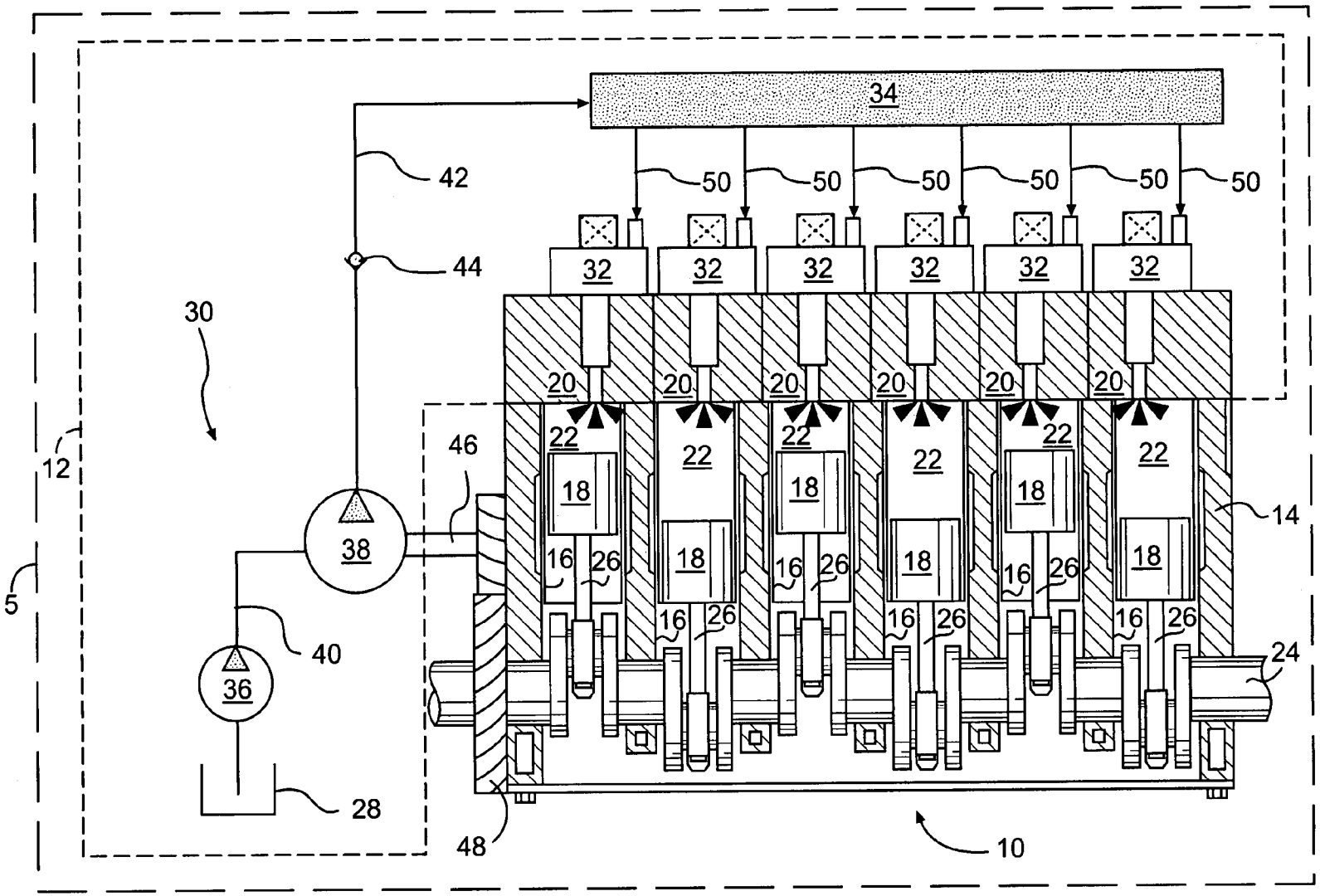
FIG. 1 is a schematic and diagrammatic illustration of an exemplary disclosed fuel system.

FIG. 1 illustrates a machine 5 having an engine 10 and an exemplary embodiment of a fuel system 12. Machine 5 may be a fixed or mobile machine that performs some type of operation associated with an industry such as mining, construction, farming, power generation, transportation, or any other industry known in the art. For example, machine 5 may embody an earth moving machine, a generator set, a pump, or any other suitable operation-performing machine.

For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that at least partially defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common rail 34. It is contemplated that additional or different components may be included within fuel system 12, if desired, such as, for example, fuel filters, water separators, makeup valves, relief valves, priority valves, and energy regeneration devices.

Fuel pumping arrangement 30 may include one or more pumping devices that function to increase the pressure of fuel drawn from tank 28 and direct one or more pressurized streams of fuel to common rail 34. In one example, fuel pumping arrangement 30 includes a low pressure source 36 and a high pressure source 38 fluidly connected in series by way of a fuel line 40. Low pressure source 36 may embody a transfer pump configured to provide low pressure feed to high pressure source 38. High pressure source 38 may be configured to receive the low pressure feed and increase the pressure of the fuel to the range of about 30-300 MPa. High pressure source 38 may be connected to common rail 34 by way of a fuel line 42. A check valve 44 may be disposed within fuel line 42 to provide for unidirectional flow of fuel from fuel pumping arrangement 30 to common rail 34.

One or both of low and high pressure sources 36, 38 may be operatively connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and fluidly connected to common rail 34 by a plurality of distribution lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position during a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Figure 2:
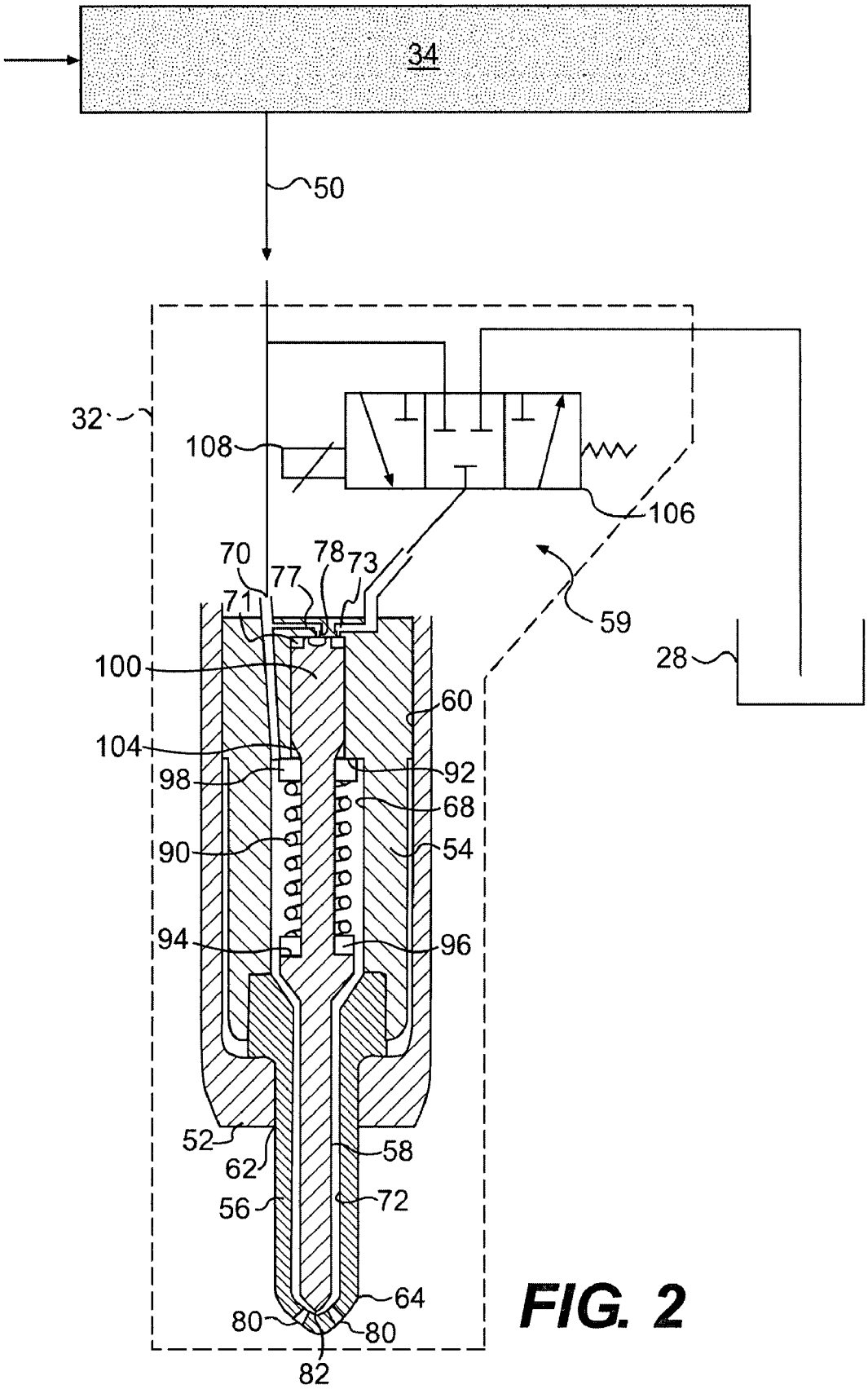
FIG. 2 is a cross-sectional illustration of an exemplary disclosed fuel injector for the fuel system of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a solenoid actuator 59, and a needle valve element 58. It is contemplated that each fuel injector 32 may embody an intensified or non intensified common rail injector, and include additional or different components than those illustrated in FIG. 2, if desired, such as, for example, additional solenoid actuators, piezo actuators, and additional valve elements.

Injector body 52 may be a cylindrical member configured for assembly within cylinder head 20. Injector body 52 may have a central bore 60 for receiving guide 54 and nozzle member 56, and an opening 62 through which a tip end 64 of nozzle member 56 may protrude. A sealing member such as, for example, an o-ring (not shown) may be disposed between guide 54 and nozzle member 56 to restrict fuel leakage from fuel injector 32.

Guide 54 may also be a cylindrical member having a central bore 68 configured to receive needle valve element 58, and a control chamber 71. Central bore 68 may act as a pressure chamber, holding pressurized fuel that is supplied from a fuel supply passageway 70. During injection, the pressurized fuel from distribution line 50 may flow through fuel supply passageway 70 and central bore 68 to nozzle member 56.

Control chamber 71 may be selectively drained of or supplied with pressurized fuel. Specifically, a control passageway 73 may fluidly connect control chamber 71 and solenoid actuator 59 for draining and filling of control chamber 71. Control chamber 71 may also be supplied with pressurized fluid via a supply passageway 77 and a port 78 that is axially aligned with needle valve element 58 and in communication with fuel supply passageway 70. A diameter of port 78 may be less than a diameter of control passageway 73 and supply passageway 77 to allow for a pressure drop within control chamber 71 when control passageway 73 is drained of pressurized fuel.

Nozzle member 56 may likewise be a cylindrical member having a central bore 72 that is configured to receive needle valve element 58. Nozzle member 56 may also include one or more orifices 80 to allow pressurized fuel from central bore 68 to spray into the associated combustion chamber 22 of engine 10.

Solenoid actuator 59 may be disposed opposite orifices 80 of nozzle member 56 to control the flow of fuel into and out of control chamber 71. In particular solenoid actuator 59 may include a three position proportional valve element 106 disposed within control passageway 73 between control chamber 71 and tank 28. Proportional valve element 166 may be spring biased and solenoid actuated to move between a first position at which fuel is allowed to flow from control chamber 71 to tank 28, a second position at which pressurized fuel from distribution line 50 flows through control passageway 73 into control chamber 71, and a third position at which fuel flow through control passageway 73 is blocked. The position of proportional valve element 106 between the first, second, and third positions may determine a flow rate of the fuel through control passageway 73, as well as the flow direction. Proportional valve element 106 may be movable to any position between the first, second, and third positions in response to an electric current applied to a solenoid 108 associated with proportional valve element 106. It is contemplated that proportional valve element 106 may alternatively be hydraulically actuated, mechanically actuated, pneumatically actuated, or actuated in any other suitable manner. It is further contemplated that proportional valve element may be a non-proportional two-position valve element that is movable between only a control chamber draining position and a control chamber filling position or between only a control chamber draining position and a blocked position, if desired.

Needle valve element 58 may be an elongated cylindrical member that is slidingly disposed within housing guide 54 and nozzle member 56. Needle valve element 58 may be axially movable between a first position at which a tip end 82 of needle valve element 58 blocks a flow of fuel through orifices 80, and a second position at which orifices 80 are open to a flow of fuel into combustion chamber 22.

Needle valve element 58 may be normally biased toward the first position. In particular, as seen in FIG. 2, each fuel injector 32 may include a spring 90 disposed between a stop 92 of guide 54 and a seating surface 94 of needle valve element 58 to axially bias tip end 82 toward the orifice-blocking position. A first spacer 96 may be disposed between spring 90 and stop 92, and a second spacer 98 may be disposed between spring 90 and seating surface 94 to reduce wear of the components within fuel injector 32.

Needle valve element 58 may have multiple driving hydraulic surfaces. In particular, needle valve element 58 may include a hydraulic surface 100 tending to drive needle valve element 58 toward the first or orifice-blocking position when acted upon by pressurized fuel within control chamber 71, and a hydraulic surface 104 that tends to oppose the bias of spring 90 and drive needle valve element 58 in the opposite direction toward the second or orifice-opening position. When biased toward the second position, needle valve element 58 may be configured to cap off supply passageway 77. Specifically, a base end 110 of needle valve element 58 may include a recess 112, having an annular rim 114 configured to engage an end wall portion 116 of control chamber 71 when needle valve element 58 is moved to the second position. The engagement of rim 114 with end wall portion 116 may substantially block the flow of pressurized fluid from supply passageway 77 into control chamber 71.

Figure 3A:
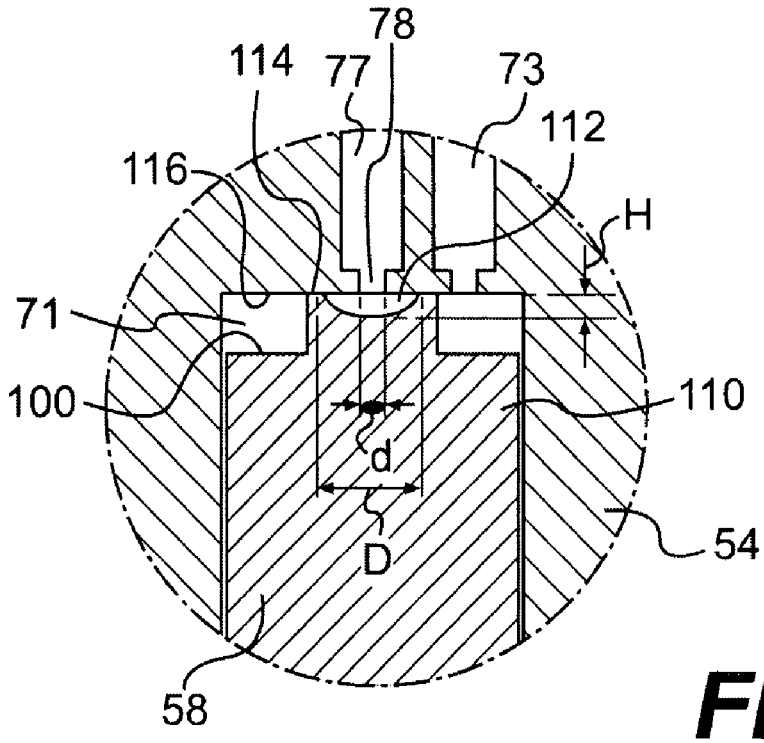
FIG. 3A is close-up cross-sectional illustration of an exemplary disclosed needle check valve arrangement for use with the fuel injector of FIG. 2.

As illustrated in the close-up of FIG. 3A, recess 112 may be concave and have an inner diameter "D" greater than an inner diameter "d" of port 78. As also illustrated in FIG. 3A, the height of recess 112 may be represented by the letter "H". The dimensions of recess 112 may be designed such that the buildup of pressure within recess 112 resulting from the closing motion of needle check valve 58 may be insufficient to cause bouncing of needle check valve 58 away from end wall portion 116. In one example, the annular surface area defined by an imaginary cylinder having a height "H" and a diameter "d" located within recess 112 below port 78 may be about four times the cross-sectional area of port 78. To provide this desired relationship, the height of recess 112 may be set to approximately the diameter of port 78 (e.g., H=d).

Figure 3B:
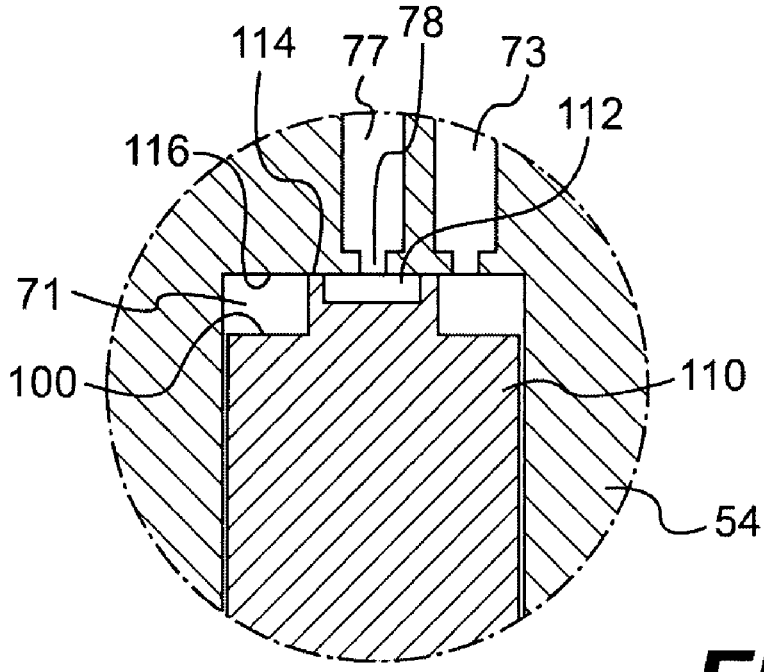
FIG. 3B is close-up cross-sectional illustration of another exemplary disclosed needle check valve arrangement for use with the fuel injector of FIG. 2.

An alternative embodiment of needle check valve 58 is illustrated in the close-up of FIG. 3B. Similar to needle check valve 58 of FIG. 3A, needle check valve 58 of FIG. 3B includes recess 112 configured to cap off supply passageway 77. However, in contrast to recess 112 of FIG. 3A, recess 112 of 3B may be cylindrical in shape.

Figure 4:
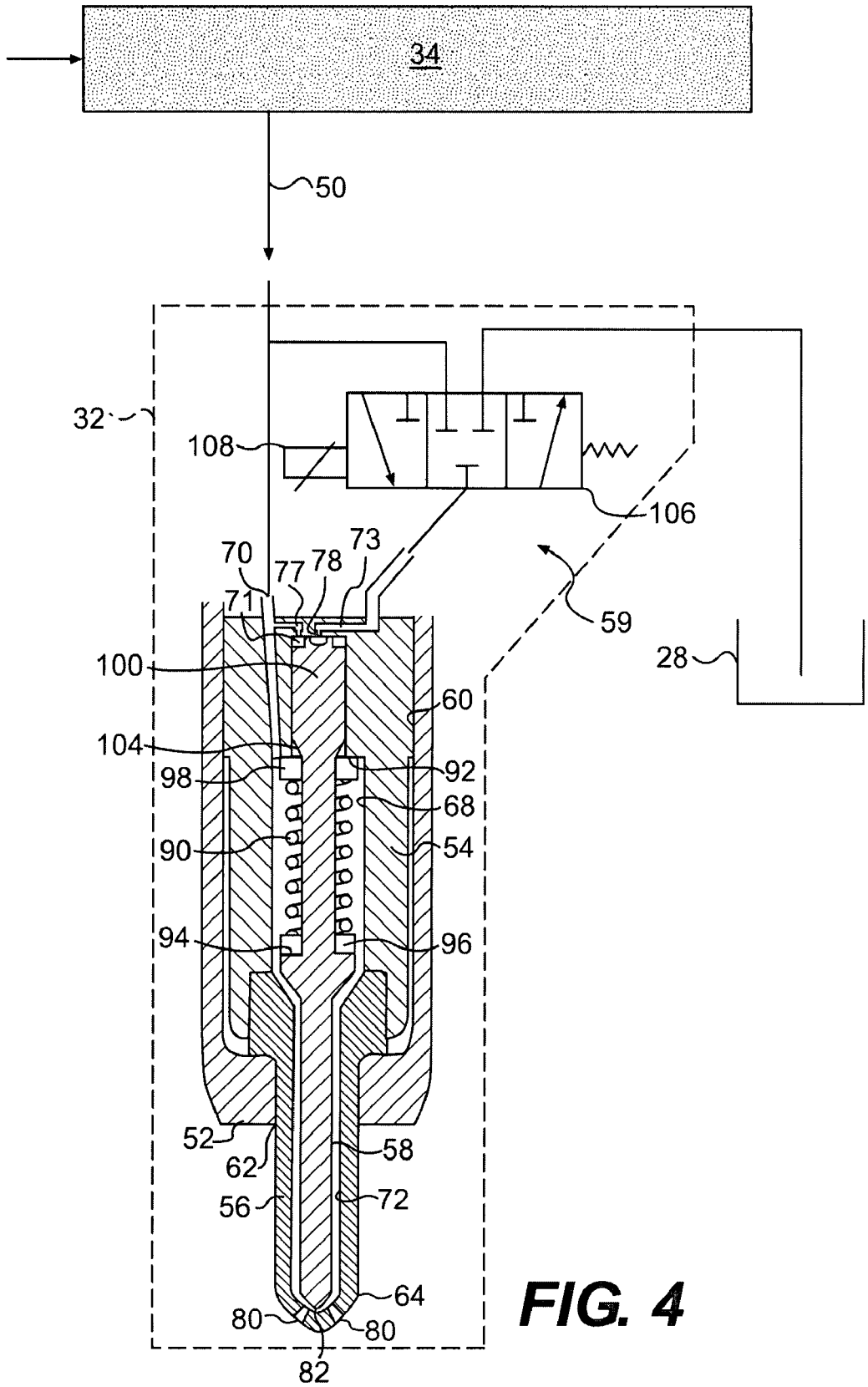
FIG. 4 is a cross-sectional illustration of an alternative exemplary disclosed fuel injector for the fuel system of FIG. 1.

FIG. 4 illustrates an alternative embodiment of fuel injector 32. Similar to fuel injector 32 of FIG. 2, fuel injector 32 of FIG. 4 includes injector body 52, guide 54, nozzle member 56, and needle valve element 58 forming control chamber 71 with supply and control passageways 77 and 73. However, in contrast to fuel injector 32 of FIG. 3, supply and drain passageways have switched positions, with recess 112 designed to cap off control passageway 73 instead of supply passageway 77.

INDUSTRIAL APPLICABILITY

The fuel injector of the present disclosure has wide applications in a variety of engine types including, for example, diesel engines, gasoline engines, and gaseous fuel-powered engines. The disclosed fuel injector may be implemented into any engine that utilizes a pressurizing fuel system wherein it may be advantageous to minimize leakage of pressurized fuel into a control chamber of the fuel injector during intentional draining of the control chamber. The operation of fuel injector 32 will now be explained.

Needle valve element 58 may be moved by an imbalance of force generated by fluid pressure. For example, when needle valve element 58 is in the first or orifice-blocking position, pressurized fuel from fuel supply passageways 77 and 73 may flow into control chamber 71 to act on hydraulic surface 100. Simultaneously, pressurized fuel from fuel supply passageway 70 may flow into central bore 68 in anticipation of injection. The force of spring 90 combined with the hydraulic force created at hydraulic surface 100 may be greater than an opposing force created at hydraulic surface 104 thereby causing needle valve element 58 to remain in the first position and restrict fuel flow through orifices 80. To open orifices 80 and initiate the injection of pressurized fuel from central bore 68 into combustion chamber 22, solenoid actuator 59 may move proportional valve element 106 to selectively drain pressurized fuel away from control chamber 71 and hydraulic surface 100. This decrease in pressure acting on hydraulic surface 100 may allow the opposing force acting across hydraulic surface 104 to overcome the biasing force of spring 90, thereby moving needle valve element 58 toward the orifice-opening position.

When needle valve element 58 is in the second or orifice-opening position,any leakage of pressurized fuel through supply passageway 77 into control chamber 71 may decrease the efficiency of engine 10. Therefore, to improve the efficiency of engine 10, rim 114 of needle valve element 58 may engage end wall portion 116 of control chamber 71 and create a seal therebetween that may minimize the likelihood of leakage. Because needle valve element 58 includes recess 112, the pressure buildup caused by the closing motion of needle valve element 58 may be absorbed by and retained within recess 112, minimizing the likelihood of needle valve element 58 bouncing away from end wall portion 116.

Because rim 114 may engage nearly any location of end wall portion 116 and still form the desired seal, misalignment between needle valve element 58 and port 78 may be inconsequential. In addition, because the mating surfaces of rim 114 and end wall portion 116 are substantially flat, the fabrication process required to make fuel injectors 32 may be relatively simple and inexpensive.

It will be apparent to those skilled in the art that various modifications and variations can be made to the fuel injector of the present disclosure without departing from the scope of the disclosure. Other embodiments will be apparent to those skilled in the art from consideration of the specification and practice of the fuel injector disclosed herein. It is intended that the specification and examples be considered as exemplary only, with a true scope of the invention being indicated by the following claims and their equivalents.

What is claimed is:

1. A fuel injector, comprising:

a nozzle member having a first end with at least one orifice, and a second end;

a control chamber located at the second end of the nozzle member and having an end wall portion approximately orthogonal to an axial direction of the nozzle member;

a fixed port disposed in the end wall portion of the control chamber;

a second port disposed in the end wall portion of the control chamber;

at least one passageway in fluid communication with the control chamber via the fixed port; and a needle valve element having:

a tip end configured to selectively block fuel flow through the at least one orifice; and a base end with a recess configured to cap off the fixed port and prevent fluid communication between the fixed port and the second port.

2. The fuel injector of claim 1, wherein the at least one fluid passageway is configured to selectively drain fuel from the control chamber.

3. The fuel injector of claim 1, wherein the at least one fluid passageway is configured to selectively supply fuel to the control chamber.

4. The fuel injector of claim 1, wherein an opening diameter of the fixed port is smaller than an opening diameter of the recess.

5. The fuel injector of claim 1, wherein the recess is concave in shape.

6. The fuel injector of claim 1, wherein the recess is cylindrical in shape.

7. The fuel injector of claim 1, wherein:

the needle valve element is movable between a first position at which the tip end of the needle valve blocks fuel flow through the at least one orifice, and a second position at which the fuel flows through the at least one orifice; and the base end of the needle valve element is configured to engage the end wall portion of the control chamber when the needle valve element is in the second position.

8. The fuel injector of claim 1, wherein the height of the recess is approximately equal to the diameter of the fixed port.

9. The fuel injector of claim 1, wherein an annular surface area defined by an imaginary cylinder having a height equal to that of the recess and a diameter equal to that of the fixed port is approximately equal to four times the cross-sectional area of the port.

10. The fuel injector of claim 1, wherein the at least one passageway has a diameter greater than a diameter of the fixed port.

11. A method of injecting fuel into a combustion chamber of an engine, the method comprising:

fluidly communicating through a fixed port with a control chamber associated with a nozzle member;

selectively moving a needle valve element to cap the fixed port and to block the fluid communication between the fixed port and a second port; and retaining fuel within a recess of the needle valve element when the fluid communication is blocked.

12. The method of claim 11, wherein fluidly communicating includes selectively draining the control chamber of fuel.

13. The method of claim 11, further including pressurizing fuel, wherein fluidly communicating includes selectively filling the control chamber with pressurized fuel.

14. The method of claim 11, wherein selectively moving includes engaging the needle valve element with an end wall portion of the control chamber.

15. The method of claim 11, wherein the recess is concave in shape.

16. The method of claim 11, wherein the recess is cylindrical in shape.

17. The method of claim 11, wherein selectively moving a needle valve element to block the fluid communication through the fixed port opens an injection port fluidly communicating the nozzle member with the combustion chamber.

18. A machine, comprising:

an engine configured to generate a power output and having at least one combustion chamber;

a source of pressurized fuel; and a fuel injector configured to inject pressurized fuel into the at least one combustion chamber and including:

a nozzle member having a first end with at least one orifice, and a second end;

a control chamber located at the second end of the nozzle member and having an end wall portion approximately orthogonal to an axial direction of the nozzle member;

a first port disposed substantially flush with the end wall portion of the control chamber;

a second port disposed in the end wall portion of the control chamber;

at least one passageway in fluid communication with the control chamber via the port; and a needle valve element movable between a first position and a second position, the needle valve element having:

a tip end configured to selectively block fuel flow through the at least one orifice when the needle valve element in the first position; and a base end configured to engage the end wall portion of the control chamber when the needle valve element is in the second position and having a recess that caps off the first port and prevents fluid communication between the first port and the second port.

19. The machine of claim 18, wherein the at least one fluid passageway is configured to selectively drain fuel from the control chamber.

20. The machine of claim 18, wherein the at least one fluid passageway is configured to selectively supply fuel to the control chamber.

21. The machine of claim 18, wherein an opening diameter of the port is smaller than an opening diameter of the recess.

22. The machine of claim 18, wherein the recess is concave in shape.

23. The machine of claim 18, wherein the recess is cylindrical in shape.

24. The machine of claim 18, wherein the height of the recess is approximately equal to the diameter of the port.

25. The machine of claim 18, wherein an annular surface area defined by an imaginary cylinder having a height equal to that of the recess and a diameter equal to that of the port is approximately equal to four times the cross-sectional area of the port.

* * * * *

UNITED STATES PATENT AND TRADEMARK OFFICE

CERTIFICATE OF CORRECTION

PATENT NO. : 7,415,969 B2
APPLICATION NO. : 11/363259
DATED : August 26, 2008
INVENTOR(S) : Jinhui Sun It is certified that error appears in the above-identified patent and that said Letters Patent is hereby corrected as shown below:

Please correct the References Cited as follows:
Title Page, item (56), under "Other Publications", in Column 2, Line 2, below "Office." insert -- Dr. Gerhard Ziegler, 2004 SAE International, "Euro 4 and Beyond – Role of Diesel Fuel Injection Systems". --.

Please correct the Specification as follows:
Column 4, line 46, delete "166" and insert -- 106 --.

Signed and Sealed this

Twenty-eighth Day of April, 2009

John Doll

JOHN DOLL
*Acting Director of the United States Patent and Trademark Office*